United States Patent [19]

Talbott et al.

[11] Patent Number: 5,043,635

[45] Date of Patent: Aug. 27, 1991

[54] APPARATUS FOR CONTROLLING POWER TO A LOAD SUCH AS A FLUORESCENT LIGHT

[76] Inventors: Edwin M. Talbott, 1314 Doves Cove Rd., Towson, Md. 21204; Charles H. Vaughan, 2718 Bradenbaugh Rd., Whitehall, Md. 21161

[21] Appl. No.: 448,985

[22] Filed: Dec. 12, 1989

[51] Int. Cl.[5] ..... H05B 37/02; H05B 41/36

[52] U.S. Cl. ..... 315/291; 315/307; 315/DIG. 4

[58] Field of Search ..... 315/291, 307, DIG. 4, 315/194, 199; 323/243

[56] References Cited

U.S. PATENT DOCUMENTS

| | | | |
|---|---|---|---|
| 4,286,196 | 8/1981 | Auer | 315/291 |
| 4,287,468 | 9/1981 | Sherman | 323/322 |
| 4,346,331 | 8/1982 | Hoge | 315/307 |
| 4,379,254 | 4/1983 | Hurban | 315/291 |
| 4,414,493 | 11/1983 | Henrich | 315/308 |
| 4,477,748 | 10/1984 | Grubbs | 315/194 |
| 4,800,330 | 1/1989 | Pelonis | 323/243 |
| 4,937,504 | 6/1990 | Black, Jr. et al. | 315/DIG. 4 |
| 4,949,020 | 8/1990 | Warren et al. | 315/307 |

*Primary Examiner*—Eugene R. Laroche

*Assistant Examiner*—Son Dinh

*Attorney, Agent, or Firm*—Laubscher, Presta & Laubscher

[57] ABSTRACT

A power controller device used for dimming fluorescent lights includes a power supply circuit for producing a rectified AC power output, a start pulse generator for producing a start pulse in response to the power output, and a switch energized in response to the start pulse to deliver power to the load. A phase detector is connected with the power supply for generating a synchronized saw-tooth voltage waveform from the rectified power output and a power level control circuit is connected with the power supply for setting a voltage threshold level for controlling the power level supplied to the load. A run pulse generator is connected with the phase detector and the power level control circuit and produces run pulses when the saw-tooth voltage waveform from the phase detector exceeds the voltage threshold level. Timer and restart circuits are also provided. The timer circuit disables the power level control circuit for a pre-determined warm-up period wherein full power is delivered to the light for start-up. The restart circuit is operable to activate the timer circuit following a brief power failure to restart the lights.

8 Claims, 3 Drawing Sheets

APPARATUS FOR CONTROLLING POWER TO A LOAD SUCH AS A FLUORESCENT LIGHT

BACKGROUND OF THE INVENTION

The present invention relates to an electrical control device which permits the control of any electrical load, regardless of load impedance. The invention has particular application to the dimming of fluorescent lights.

The ability to modulate illumination levels on a continuously variable basis has long been desirable for a number of reasons. These vary from convenience and aesthetics in homes and restaurants to the potential for saving energy in commercial and other establishments where lighting is a major user of electric power.

In the case of stores and large offices, light levels higher than needed offer a double energy penalty. Not only does the lighting consume more power than necessary, but this heat energy then must be removed by air conditioning, another major user of energy. In many large buildings, the heat provided by lighting and the occupants requires air conditioning even in the winter. For such installations, fluorescent and other gaseous lighting has been found to be much more economic than the very much less efficient incandescent lights. It is rare to find incandescent lighting used extensively in commercial, institutional, or office locations.

Many building managers and other managers who are conscious of cost and energy have attempted measures to reduce or modulate the light levels so as to provide only the needed amount of light. Throughout the corridors of many buildings, many of the fixtures have been removed from service. In other cases, occupants of offices having outside windows are urged to turn off their lights when light from the windows is sufficient. In other buildings, there are switching arrangements providing a level of illumination for after-hours periods which is lower than that during working hours. This is to permit cleaning personnel and occasional occupants to pass through the areas safely.

In offices where video display tubes (VDT's) are used, there is a persistent problem of establishing an ambient light level compatible with both the luminescent level of the VDT's and illumination of the papers and printed matter associated with the use of word processors and computers. Many offices report unnecessary fatigue because of the inability to control illumination levels.

In order to be able to better manage these lighting levels, it is desirable to be able to control or modulate the power to this lighting, just as can be done with the dimming controls available for incandescent lights. These latter controls have become popular and are used in many places. However, their use for controlling gaseous tube fixtures, such as standard fluorescent lights, produces unsatisfactory results. This is because the fluorescent tube, with an associated ballast, is a reactive load which cannot be controlled effectively and reliably by a standard dimmer control.

BRIEF DESCRIPTION OF THE PRIOR ART

An earlier series of products enabled the installation of a simple controller in a switch box, but not as a simple switch replacement because it was necessary to have access to both sides of the power line. While the prior products were satisfactory, the parallel connection relative to the load hindered their acceptance.

Since most light switches are mounted in a box on the wall, the line to the switches is simply dropped from fixture to the switch and the other side of the line is not conveniently present. Therefore, if a controller is to be a true switch replacement, it must operate in series with the load as in the case of incandescent lamp dimmers.

The advent of inexpensive solid state switching devices has made possible the evolution of a wide variety of control circuits which are light, small, and economic. The variable transformer type voltage controls long have been superseded in most cases by controls which serve to modify the basic AC voltage sine wave in such a way as to selectively reduce the rms voltage and power being delivered.

A conventional incandescent light dimmer, for example, clips the voltage wave form. The result is that the rms voltage delivered to the load is lowered, reducing the power accordingly.

The basic problem is that these simple circuits cannot modulate reactive loads. Such loads react with the controller, producing oscillations which then cause surges of voltage and current which are both unpredictable and uncontrollable. When such control is applied to fluorescent lights, the usual result is a non-harmonic type of flickering, frequently taking the light from zero output to maximum. Such effects are discomforting and perhaps unhealthful for the user.

A number of circuits have been designed to overcome this problem. One type offered for some years requires that each ballast in the fixtures be removed and replaced by a controlling ballast. The installation costs of such a practice are prohibitive, and the energy saving would, in most cases, not be adequate to justify the modification. The engineering situation has been complicated further by the introduction of filament-free (slimline) lamps.

Other types of controls are satisfactory for wiring into large systems where it is permissible to have one large and costly master controller raise or lower the light level of a whole floor or portion of a building. In most cases, this type of control is not acceptable to the various users who may have different lighting demands at different times in different locations. Still other types of systems have been applied to the gas lamps in copy machines. But again, the requirement is quite different from that of space illumination, and a larger, more complex system can be tolerated. There are a number of engineering approaches to the dimming of fluorescent lighting. Some maintain full filament voltage while reducing the power to the lamps, thus permitting dimming to be satisfactory at much lower light levels. Others have light sensing and feedback control maintaining constant brilliance at whatever level is set. Still others control circuits that maintain clean sine-waves on the fixtures at all levels, thus avoiding the radio frequency noise and some other less suitable characteristics of lamp dimming. All of these, however, are expensive to build and to install and most often are available only for simultaneously controlling large quantities of fluorescent lamps.

The present invention was developed in order to overcome these and other drawbacks of the prior devices by providing a fluorescent lamp dimming device which can be installed directly as a switch replacement, mounted in series with the lamp and having access for power and operation to only one side of the electrical line supplying the lamp.

SUMMARY OF THE INVENTION

Accordingly, it is a primary object of the present invention to provide a device for controlling the power supplied from an AC source to a load such as a fluorescent light. The device includes a power supply for producing a rectified AC power output, a start pulse generator connected with the power supply for producing a start pulse in response to the power output, and a switch connected with the power supply and the start pulse generator. The switch is energized by the start pulse to supply power to the load. A phase detector is connected with the power supply for generating a synchronized saw-tooth voltage waveform from the rectified power output to create a time delay. A power level control circuit is connected with the power supply to set a voltage threshold level for controlling the power level supplied to the load. A run pulse generator is connected with the phase detector and with the level control circuit. The run pulse generator compares the saw-tooth voltage waveform with the voltage threshold level and produces a run pulse for energizing the switch when the saw-tooth voltage waveform exceeds the voltage threshold level. The power level control circuit controls the number of run pulses generated to energize the switch, thereby controlling the power supplied to the load.

A timing circuit is connected with the level control circuit to disable the same for an initial pre-determined period of time. During this time period, full power is supplied to the load for start-up.

A restart circuit is connected with the power supply and the timing circuit for restarting the load in response to a brief interruption of power from the power supply. The restart circuit includes a comparator which compares the voltage from the power supply to a given voltage level. The restart circuit disables the run pulse generator when the comparator senses when the power supply voltage falls below the given voltage level. When the power supply voltage rises back above the given level, the restart circuit enables the timing circuit for start-up of the load.

According to a further object of the invention, the power supply includes a transformer for producing the rectified power output, with output current from the switch being supplied to the transformer.

According to another object of the invention, the power level control circuit includes two potentiometers, one for setting a minimum voltage threshold level and the other for controlling the voltage threshold level supplied to the load.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
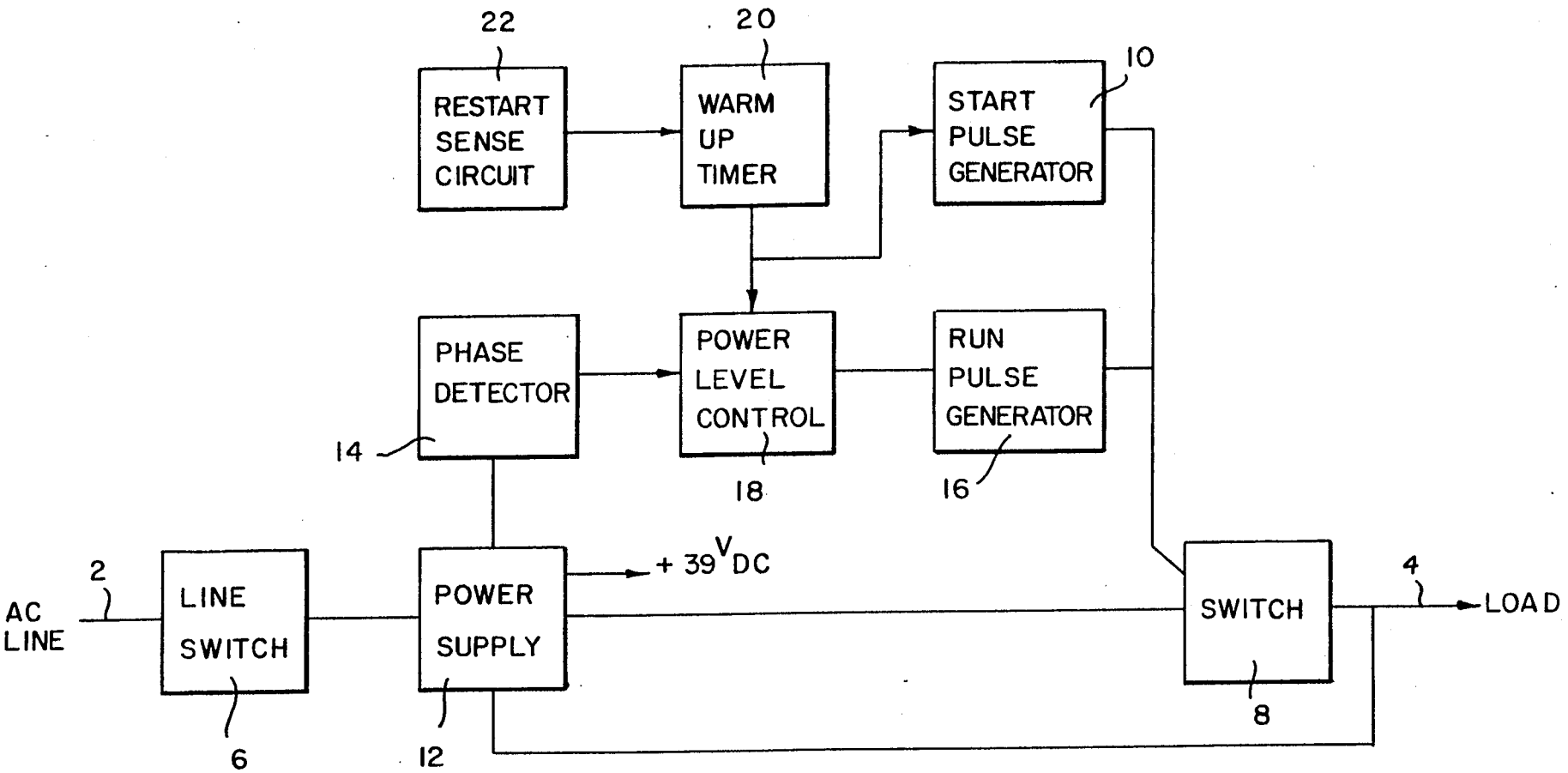
FIG. 1 is a block diagram of the power supply controlling device according to the invention.

Referring first to FIG. 1, there is shown a block diagram of the apparatus for controlling the power supplied from an AC line to a load such as a fluorescent light. The apparatus includes an input terminal 2 for connection with an AC power line and an output terminal 4 connected with a line to the load. The apparatus is thus a two-wire device and is connected in place of a standard on-off switch to variably control the power delivered to the load.

A line switch 6 is connected with the input terminal 2 and a switch 8 is connected with the output terminal 4. The switch 8 preferably comprises a TRIAC switch. Operation of the apparatus begins when the line switch 6 is closed, and AC voltage then appears across the switch 8. At this time, the switch is not turned on. Rather, it awaits a signal on its gate which must come from the start pulse generator 10.

The start pulse generator 10 cannot function until the power supply 12 connected with the line switch 6 is able to supply its primary output of 39 volts. From time zero when the line switch 6 is first turned on, the power supply 12 begins receiving charging current from the output of the TRIAC switch 8. The output of the power supply 12 normally reaches the 39 volt level about one second later. During this charging time, the start pulse generator 10 is also being charged and, within this one second period, the start pulse generator will produce a start pulse which turns on the switch 8. Once the switch has been activated, all load current is drawn through the power supply 12 and is used to sustain its 39 volt output.

A phase detector 14 is connected with the power supply 12 and monitors the non-linear current waveform through components in the power supply 12. The phase detector 14 generates a synchronized saw-tooth waveform of voltage which is then used to create a time delay for the triggering of a run pulse generator 16. The longer the time delay in creating the run pulse, the smaller the amount of power received by the load.

A power level control circuit 18 is connected between the phase detector 14 and the run pulse generator 16 and provides the user with potentiometer controls to set both the minimum power that the control circuit will deliver and also the power level setting that is currently desired. These circuits then set a threshold voltage which controls a voltage comparator as will be discussed in greater detail with regard to FIG. 2. The saw-tooth voltage is also tied to the voltage comparator and, when the saw-tooth voltage exceeds the threshold voltage, the run pulse generator 16 is triggered, which then triggers the switch 8 to the on position again. Since the phase detector functions as a full-wave circuit, the run pulse generator is triggered twice during each cycle of the AC power.

In order to operate fluorescent lights, it is necessary to turn them on and first operate them at full brilliance so that time is allowed for warm-up and impedance stabilization. A warm-up timer 20 connected with the power level control circuit 18 is used in the apparatus to provide for this need. The warm-up timer modifies the level control circuit so that the lights will remain maximum brilliance for a given period of time, e.g. 12–15 seconds. After that time, the lights will dim down to the level previously set by the level control potentiometer.

In the event of a power failure, it is necessary to include a restart sense circuit 22. The function of the restart sense circuit is to reinitialize the warm-up timer 20 and cause the start pulse generator to again be triggered when power is again available. This circuit functions normally for power outages of short duration. It is not possible, however, to store enough power in the circuit to restart the lights after a power outage of a few seconds. At that point, the line switch 6 must be turned off and then turned back on again to restore the fluorescent lighting.

Figure 2:
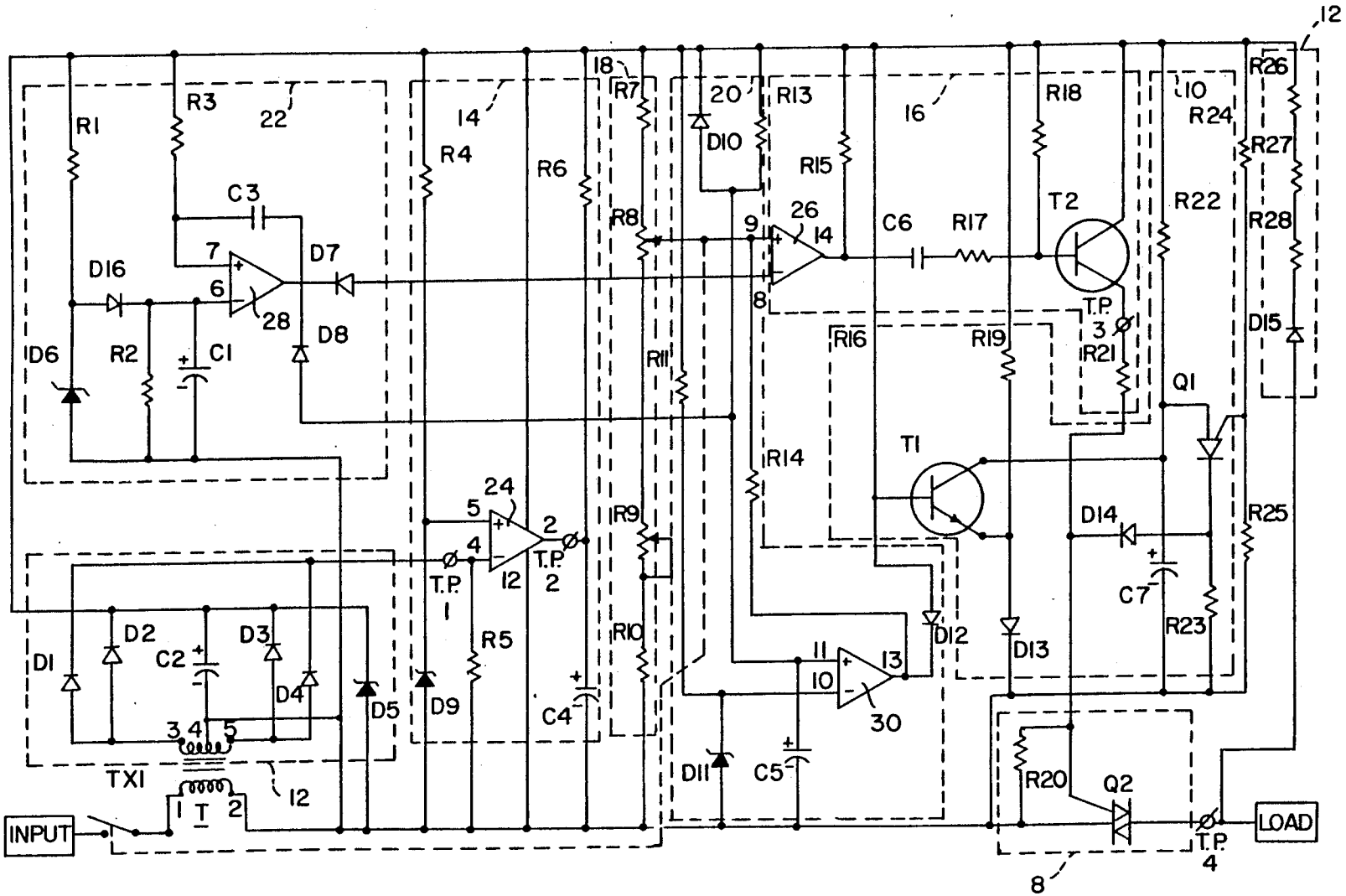
FIG. 2 is a circuit diagram of the device of FIG. 1.

In FIG. 2, there is a schematic diagram of the block diagram of FIG. 1. The power supply 6 is shown in two areas of FIG. 2. At the right of the circuit, a half-wave rectifier circuit portion of the power supply is shown. The rectifier circuit comprises diode D15 and resistors R26, R27, and R28 and is used to charge the power supply filter capacitor C2 during the period when the switch 8 is not energized.

Figure 3:
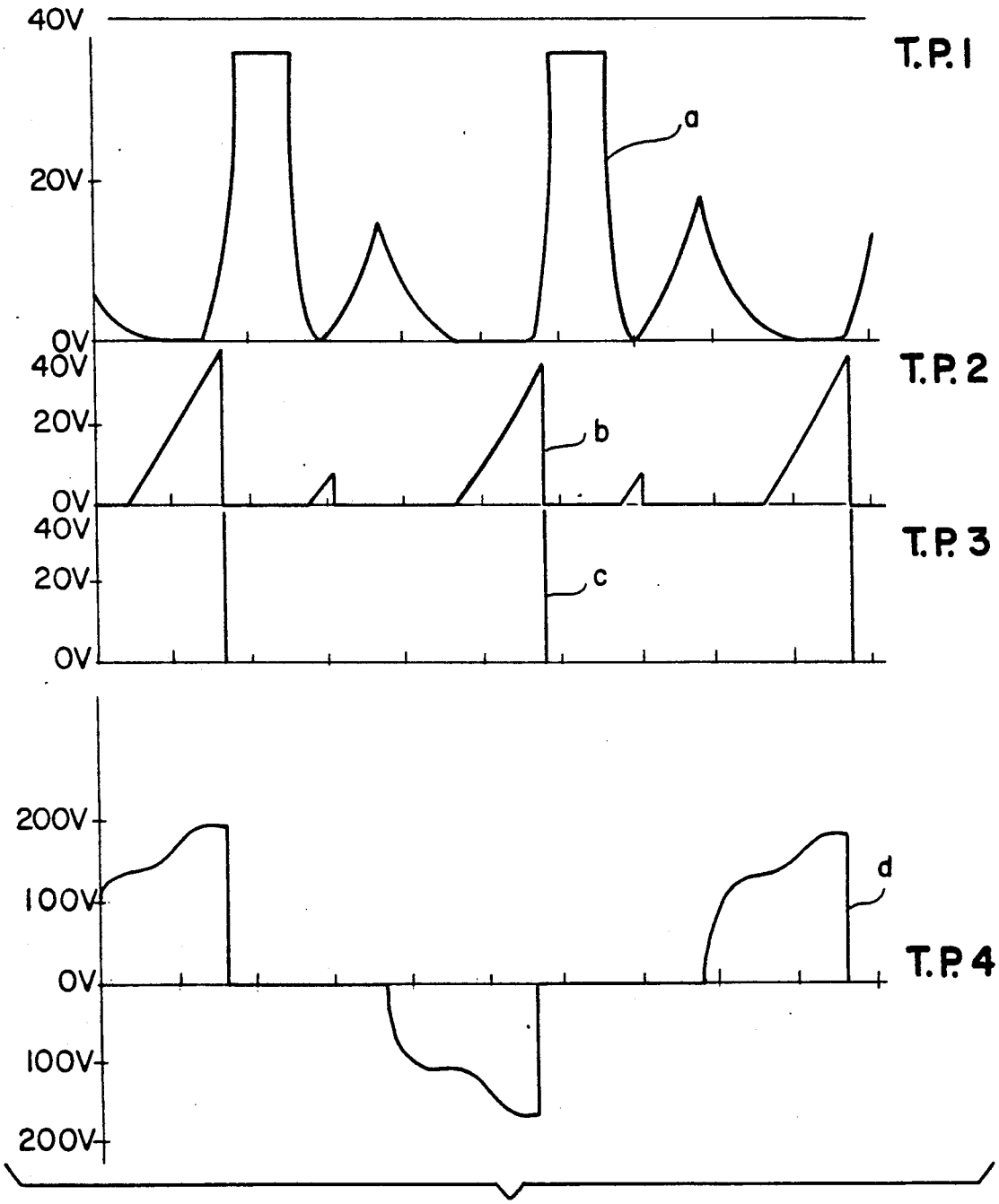
FIG. 3 is an illustration of the waveforms appearing at specific locations in the circuit of FIG. 2.

When power is first applied, the power supply filter capacitor C2 has been previously completely discharged and, before any operation can occur, the capacitor must be recharged, and the charging current is provided through the diode 15 and resistor network. Once the switch 8 has been fired and continues to trigger during the operation of supplying current to the load, a current sensing transformer TX1 is used for a full-wave rectifier output to bring the current capability of the power supply 12 up to what is needed for continuous operation of the circuit. Zener diode D5 limits the positive output level of the power supply at 39 volts. The waveform for the output of the power supply taken at test point 1 (T.P.1) of FIG. 2 is shown by curve a in FIG. 3.

The start pulse generator 10 is the circuit centered on the transistor Q1, a 2N6028 unijunction transistor. The unijunction transistor circuit is biased so that it can produce one pulse at the end of a time duration governed by the time constant of resistor R22 and capacitor C7 as well as the bias level created by resistors R24 and R25. The unijunction transistor will go abruptly into conduction when the voltage across capacitor C7 reaches a level 6/10 of a volt above the bias voltage created by the voltage divider of resistors R24, R25. The power supply circuit constants are adjusted so that the bias voltage at transistor Q1 rises faster than the voltage on capacitor C7 so that a power supply capacity of nearly 39 volts is reached before the transistor Q1 fires. At this point, the charge on capacitor C7 is conducted through the transistor and then through the diode D14 to the gate of the switch Q2. Resistors R23 and R20 provide the functions of pull-down loads for when the pulse is not present, thereby holding the gate of the switch at a zero voltage potential as well as resistor R23 holding the cathode of transistor Q1 at a zero voltage potential. Once the capacitor C7 has been discharged, the current flowing through resistor R22 and then through the transistor Q1 is enough to maintain conduction in transistor Q1 and, therefore, prevent capacitor C7 from being recharged.

To provide the capability for restart, a transistor T1 is included to clamp the anode voltage of transistor Q1 to a 1-volt level at the end of the warm-up timer period. When this is done, conduction through transistor Q1 ceases and, as long as the clamp is held on, capacitor C7 does not recharge. Transistor T1 is held in conduction and therefore clamps the start-pulse generator until the warm-up timer circuit 20 is again retriggered as will be discussed in greater detail below.

The phase detector circuit 14 uses a comparator 24 which is one section of an LM339 integrated circuit. The input of this comparator is biased on pin 5 by a constant 5.1 volt level from the Zener diode D9. The other input of the phase detector comparator 24 comes from the full wave rectifier formed by the current transformer TX1 and the diodes D1 and D4. When the start pulse keys on the switch Q2, heavy current will flow through the transformer primary causing a voltage to occur at pin 4 of the comparator. This voltage is proportional to the current flow and will generally be much greater than the 5 volt bias level on the other input pin. Therefore, the comparator 24 will be triggered and its output will pull to ground. It will remain in this condition until the current stops at the time of the AC voltage zero crossing. At this time, the switch Q2 will cease conducting, causing the voltage at pin 4 to drop to zero. When this occurs, the comparator output will go to a high impedance condition and the capacitor C4 will start charging by current through resistor R6. Time constants for resistor R6 and capacitor C4 cause the voltage level to be nearly linearly increasing during the time period of interest. Therefore, the voltage to be seen on the capacitor C4 will appear as a saw-tooth rim with its zero point synchronized at the time of cut-off as shown by curve b in FIG. 2 taken at test point T.P.2. Actually the start occurs just a little bit prior to the current cut off because of the 5 volt bias offset, but the time is still a synchronous reference.

The saw-tooth waveform generated as the output of phase detector circuit 14 is connected with the voltage comparator 26 located in the run pulse generator circuit 16. This comparator 26 is again biased by a positive voltage on its plus input, pin 9, and the saw-tooth is applied to its negative input on pin 8. When the voltage rise of the saw-tooth reaches the bias on pin 9, the comparator 26 will go sharply into conduction and its output will fall to zero. Since the saw-tooth started at a time synchronized with the zero crossing of the AC power line voltage, the output negative transition of the comparator 26 is also synchronized with the AC wave form, but is displaced in time relative to the bias voltage set at pin 9.

The output of the pulse generator comparator 26 will remain at a zero level until the saw-tooth voltage is cut off again at the end of the AC power line half-cycle transition. This negative-going signal is differentiated by the coupling circuit of capacitor C6 and resistor R17, so that only the leading edge of the negative going signal is conducted to the gate of transistor T2. Capacitor C6 and resistor R17, therefore, allow current to flow into the base of the transistor T2 for only a few microseconds. This causes the transistor to conduct and transfer a heavy current flow to the gate of the switch Q2 and, therefore, turn it on at the time selected by the adjustment of the bias level on the pulse generator comparator 26. Current flow into the gate of the switch is adjusted by the collector resistor R21 to a current pulse of about 200 milliamperes for a period of less than 10 microseconds. Resistor R18 on the base of transistor T2 causes the base voltage to return to a zero voltage level relative to the emitter and, therefore, turns the transistor off and holds it off until another pulse comes from the pulse generator comparator 26.

Turning now to the power level control circuit 18, the bias voltage level on the pulse generator comparator 26 is adjusted by a potentiometer R8. This potentiometer is conveniently accessible to the user by a power level control knob. Potentiometer R8 is in a voltage divider string of resistors R7, R8, R9, and R10. The design of this voltage divider provides, then, an upper and lower limit to the voltage that can be applied to pin 9 of the pulse generator comparator 26. The upper limit is a voltage which is controlled by the current through the resistor R7. The lower limit, however, is controlled by setting a potentiometer R9 so that the power control potentiometer R8 can never be set to a point where the fluorescent lights go out. Potentiometer R9 is accessible by a screwdriver adjustment and is adjusted at the time of installation and sometimes later after the fluorescent lights have aged to a point where the lights flicker when the control knob is turned to its minimum setting. When this occurs, potentiometer R9 is readjusted to raise the minimum limit above the point where the lights flicker.

The restart sense circuit 22 provides the capability for the apparatus of the invention to automatically restart the fluorescent lights after a short power failure. If a momentary power outage occurs and the fluorescent lights have been adjusted to a low level, they will not restart at that low level of adjustment. The restart sense circuit 22 again uses a voltage comparator 28, a section of the LM339 integrated circuit, which monitors a power supply voltage and determines when it drops below 20 volts. This is accomplished by biasing the negative input of the comparator 28 at a 20-volt level which is set by the voltage conduction point of the Zener diode D6.

Diode D6 is held in conduction as long as the power supply voltage exceeds the 20 volts by the current flowing through resistor R1. The 20 volt bias is used to charge capacitor C1 which stores that voltage level even though the power line may from time to time dip below it. When the power line voltage drops, the charge on capacitor C1 slowly discharges through resistor R2 and will drop to zero in about six seconds. Therefore, power outages of a duration less than about 2 seconds can be automatically handled by this circuit. When the power supply voltage falls below a 20 volt bias level, the output of the comparator 28 will pull to ground and cause capacitors C4 and C5 to be discharged. Capacitor C4, as set forth above, is the saw-tooth charge regulating capacitor and the saw-tooth voltage would then be reduced to approximately a one volt level which would be far below the pulse generator threshold. Therefore, this circuit disables the pulse generator through diode D7. A second diode D8 connects to capacitor C5 and also discharges it. In doing so, it allows the 12-second warm-up timer to restart and, therefore, initiates a restart process.

The warm-up timer 20 operates at two different times in the operation of apparatus according to the invention. Its first period of operation is during the initial start-up of a set of fluorescent lights. The second time the warm-up timer is used is when the fluorescent lights must be restarted after a momentary power loss. The warm-up timer includes a fourth comparator 30 from the LM339 integrated circuit. Timing is achieved by comparing voltage from a Zener diode D11 with the voltage resulting from the charge on capacitor C5. At initial start-up, the voltage across diode D11 will rise in step with the power supply voltage as the power supply capacitor C2 is charged by the power supply circuit D15, R28, R27, and R26. This is a positive voltage connected with the negative terminal of the comparator 30 and, for the first period of operation, i.e. 12 seconds, the voltage on the Zener diode D11 and pin 10 of the comparator will be more positive than the voltage on pin 11. Therefore, the comparator's output will remain in a low state. This low condition causes current to flow in resistor R14 pulling the voltage at the positive input pin 9 of the pulse generator comparator to a lower value of voltage than is set by the operating potentiometer.

This change in threshold causes the controller to apply the maximum power available to the output load. Therefore, the fluorescent lights will come on at full brilliance and remain at this level until the timer releases its control. This occurs when capacitor C5 charges to a voltage level just above the 20 volt bias level set by diode D11. At this time, the output of the comparator will go to a high impedance state and allow the threshold of the pulse generator comparator to return to the level set by the control potentiometer. As discussed above, the output of the warm-up timer is also connected with the transistor T1 through the diode D12. This connection allows the warm-up timer to enable the start-pulse generator because when the warm-up timer comparator output is pulled low, it also pulls the base voltage of transistor T1 to a low state below its turn-on bias allowing the collector to float and, therefore, allowing capacitor C7 in the start pulse generator to start charging.

When the timer turns off, its output goes to the high state. Therefore, the base of transistor T1 is allowed to rise due to the current flowing through resistor R16 so that it will turn on and short out capacitor C7, disabling the start pulse generator 10 during the normal run times. In the situation resulting from a momentary power failure, the restart sense circuit 22 can also initiate the action of the warm-up timer 20 by causing capacitor C5 to be discharged through diode D8 when the reset sense circuit output pulls to ground. This causes the bias voltage on pin 11 of the warm-up timer to be reduced far below the other input of 20 volts from diode D11 and, therefore, the output goes low, shifts the operating level to maximum power output for maximum light brilliance, and allows the start-pulse generator to operate so that a restart will occur.

While in accordance with the provisions of the patent statute, the preferred forms and embodiments of the invention have been illustrated and described, it will become apparent to those of ordinary skill in the art that various changes and modifications may be made without deviating from the inventive concepts set forth above.

What is claimed is:

1. Apparatus connected in series with a load for controlling the power supplied from an AC source to the load such as a fluorescent light, comprising (a) power supply means connected in series with the load for supplying a rectified AC power in a two-wire circuit when the neutral AC power line is not accessible;

(b) a start pulse generator connected with said power supply means for producing a start pulse in response to the power output;

(c) switching means with said power supply means and with said start pulse generator, said switching means being energized in response to said start pulse to supply power to the load;

(d) phase detector means connected with said power supply means for generating a synchronized saw-tooth voltage waveform from said rectified power output, said saw-tooth voltage waveform creating a time delay;

(e) power level control means connected with said power supply means for setting a voltage threshold level for controlling the power level supplied to said load; and (f) a run pulse generator connected with said phase detector means and with said level control means for comparing said saw-tooth voltage waveform with said voltage threshold level, said run pulse generator producing a run pulse for energizing said switching means when said saw-tooth voltage waveform exceeds said voltage threshold level, whereby upon operation of said level control means, the run pulses generated by said run pulse generator may be controlled to control the operation of said switching means and for supplying power to load.

2. Apparatus as defined in claim 1, and further comprising timer means connected with said level control means for disabling said level control means for an initial predetermined period of time, thereby to provide maximum power to the load for start-up thereof.

3. Apparatus as defined in claim 2, and further comprising means for restarting the load in response to a brief interruption of power from said power supply means.

4. Apparatus as defined in claim 3, wherein said restarting means comprises (a) means for sensing when the voltage from said power supply means drops below a given level and for disabling said run pulse generator in response thereto; and (b) means for enabling said timer means when said voltage rises above said given level to restart the load.

5. Apparatus as defined in claim 4, wherein said power supply means includes a transformer for producing said rectified power output.

6. Apparatus as defined in claim 5, wherein output current from said switching means is supplied to said transformer.

7. Apparatus as defined in claim 6, wherein said phase detector means includes a first comparator which produces an output when said rectified power output exceeds a given bias level, thereby to generate said synchronized saw-tooth voltage waveform.

8. Apparatus as defined in claim 4, wherein said power level controller includes first potentiometer means for controlling a minimum voltage threshold level and second potentiometer means for controlling said voltage threshold level supplied to the load.

* * * * *